United States Patent [19]

Glaser

[11] 4,108,281

[45] Aug. 22, 1978

[54] ELEVATOR DOOR TAMPERING PROTECTION SYSTEM

[75] Inventor: Walter G. Glaser, Montvale, N.J.

[73] Assignee: G.A.L. Manufacturing Corporation, Bronx, N.Y.

[21] Appl. No.: 794,019

[22] Filed: May 5, 1977

[51] Int. Cl.[2] ..... B66B 13/22

[52] U.S. Cl. ..... 187/29 R

[58] Field of Search ..... 187/29

[56] References Cited

U.S. PATENT DOCUMENTS

| | | | |
|---|---|---|---|
| 1,934,867 | 11/1933 | Lindstrom et al. | 187/29 |
| 2,776,731 | 1/1957 | Savino et al. | 187/29 |
| 2,867,292 | 1/1959 | Bruns | 187/29 |

*Primary Examiner*—Robert K. Schaefer
*Assistant Examiner*—W. E. Duncanson, Jr.

[57] ABSTRACT

An automatic elevator system having car movement controls, door controls, a door operating mechanism for automatically opening and closing at least the car door and first switch contacts operable when the car and hoistway doors are closed to permit the car to move from a floor in combination with further switch contacts which are operable in accordance with the positions of the doors and which prevent the car from moving from a floor when the first switch contacts are operated before the further switch contacts to prevent movement of the car from a floor when the first switch contacts have been operated or shunted by unauthorized persons or by a short circuit.

9 Claims, 5 Drawing Figures

ELEVATOR DOOR TAMPERING PROTECTION SYSTEM

This invention relates to circuits for preventing elevator car movement from a floor in the event that normal operation of conventional door switches and/or interlock switches used therewith has been modified by interference therewith or shorting thereof.

Automatic elevator car systems, i.e., systems in which the car door automatically opens when the car reaches a floor and close before the car leaves a floor, are well-known in the art. In such systems, the hoistway door may be automatically opened and closed or may be manually opened and closed. In such systems, there usually is a switch or switches operable when the hoistway door is closed and a switch or switches operable when the car door or gate is closed which permits the car hoisting apparatus to move the car to another floor when all switches have been operated. Also, such systems usually include locking circuits which prevent opening of the doors unless the car is substantially level with the floor at which the doors control entrance to and egress from the car and include a safety edge on one or more of the doors to recycle the doors and prevent starting of a car from a floor when closing of a door is obstructed.

Such known systems operate satisfactorily when there is no deliberate interference therewith. However, juveniles, persons intending to commit robbery and others, find it exciting or convenient to interfere with the normal operation for mischievous or criminal reasons and learn how to disable a car, to prevent normal door operation or to leave open a hoistway door after the car has left the fllor where the door is located.

For example, when the hoistway door is open, the switch or switches operable thereby are accessible to the knowledgeable. Although such opening of the door will, by reason of the conventional circuits, stop the associated car, the hoistway door switch, which is on the hoistway wall, may be disabled or by-passed intentionally, such as by a shunt, to permit the car to continue to operate or may be accidentally by-passed, such as by shorting thereof.

Similarly, the car door or gate switch or switches are accessible from the car doorway or the hoistway doorway, and if the switch or switches are disabled or by-passed, the car will move even if the door or doors of the car are not closed, creating a passenger hazard and permitting the car to be stopped and started by manipulation of the car door switch or switches.

Conventional elevator systems also may have either an automatic sliding or a manually operable, swinging hoistway door.

Many of such known systems are in use, and the main object of the invention is to permit the addition to such systems of relatively simple apparatus which will make it extremely difficult to tamper with normal operation of an elevator car without causing the car to remain at the floor where the tampering occurs and, preferably, causing the sounding of an alarm. However, the principles of the invention are also applicable to newly installed elevator systems.

It has heretofore been proposed for elevator systems having swinging hoistway doors that duplicate hoistway or floor door switches be added at the floors of a building which are inaccessible from the car or hoistway doorway and which are protected to prevent movement of a car when the normal floor door switches are tampered with or are accidentally by-passed. However, such duplicate switches must be installed in the hoistway with separate wiring and protect against only by-passing of the floor door operated switches. Also, such duplicate, or back-up, switches are operated at the same time as the normal switches and if similar switches are used in elevator systems having power operated, sliding, hoistway doors, the car would be stopped at a floor with the doors closed thereby preventing passenger egress without further action by a passenger or supervisory personnel. In the preferred embodiment of the invention for the latter elevator system, the doors are prevented from closing and are reopened if partly closed when the normal floor door switches or the normal car door switches are by-passed or tampered with.

In the preferred embodiment of the invention for use when both the hoistway and car doors are of the sliding type, two switches are provided at the top of the elevator car where they are inaccessible except by gaining access to the top of the car, and such access to the top of the car can be gained substantially only by authorized personnel or those with the special knowledge of such personnel. Such switches are operable by a cam or cams driven by the car door operating mechanism on the top of the car and control relays which interrupt the circuits for the car hoisting apparatus, which cause the doors to open and which, preferably, cause an alarm to sound whenever the hoistway door or the car door is not almost fully closed when the switches normally operated by such doors to indicate that the car should start have been operated or by-passed before the door reaches the almost fully closed position thereof. In such almost fully closed positions, such normally operated switches are inaccessible from the floor or from inside the car. Preferably, also, the hoistway door or doors and the car doors are provided with mechanical interengaging devices so that, when a car is at a floor, the hoistway door at the floor cannot be opened without opening the car door and the car door cannot be closed without closing the hoistway door at the floor.

In the preferred embodiment of the invention for use when the hoistway door is a swinging door and the car door or doors are of the sliding type, three switches, one actuated by the hoistway door and located at an inaccessible position, such as above the door frame and enclosed, and the other two at an inaccessible position on top of the car and operable by a cam or cams driven by the car door operating mechanism, are used to control relays which interrupt circuits for the car hoisting apparatus, which cause the car doors to remain open or re-open and which, preferably, cause an alarm to sound whenever the switch normally operable by the hoistway door is operated or by-passed before the hoistway door reaches its almost fully closed position, whenever the switch normally operable by the car door is operated or by-passed before the car door is substantially fully closed, and whenever the door interlock switches are operated or by-passed before the car door is substantially fully closed.

One advantage of the invention is that protection against tampering with the normal operation of the elevator system is provided with relatively simple changes in a conventional automatic elevator system.

Another advantage of the embodiment of the invention is that in elevator systems in which both the hoistway and car doors are of the sliding type, it is unnecessary to add equipment on the hoistway wall and the doors re-open if the hoistway door or car door switches are tampered with.

'Other objects and advantages of the invention will be apparent to those skilled in the art from the following description of the presently preferred embodiments thereof, which description should be considered in conjunction with the accompanying drawings in which.

CONVENTIONAL SLIDING DOOR SYSTEM AND MODIFICATION

As mentioned hereinbefore, the invention relates to modification of well-known types of automatic elevator car systems. Such systems and components thereof are, for example, illustrated in U.S. Pat. Nos: 1,680,771; 1,876,438; 1,929,391; 2,019,456; 2,185,748 and 2,432,293 and in various technical publications including service manuals published by various elevator manufacturers.

In general terms, such systems include the following:

(1) At least one elevator car mounted for vertical movement in a hoistway extending between a plurality of floors in a building, said car having a sliding door, either one, two or more parts.

(2) A hoistway door at each of the floors to provide access to the car, the door usually being of one or more sliding parts or being a one-part, pivotally mounted, swinging door.

(3) Control means including hoisting apparatus for moving the car from one of the floors to another, stopping the car at a floor, causing opening and closing at least of the car door at a floor at which the car is stopped, such control means being responsive to manually operable push buttons in the car and at each floor, to various switches on the car and at the floors, etc.

(4) Motor driven door operating means at the top of the car for opening and closing the car door when the floor door is a swinging door and both the car door and the floor door when both doors are sliding doors.

(5) A plurality of switches on the car and at the floors which are connected to the control means and which, when all the doors are closed and locked, permit operation of the circuits in the control means which cause the car to move. Usually included in such plurality of switches are a switch at each floor controlled in accordance with the position of the car door and operated by the locking mechanisms which hold the doors closed until the locking mechanisms are automatically released when the car is at a floor.

(6) Safety devices for preventing closing of the doors when a passenger is entering or leaving a car, one example of such a device being a so-called "safety edge" which usually contains a switch operable by an obstruction in the car doorway to cause the doors to re-open or at least stop further closing movement.

Figure 1:
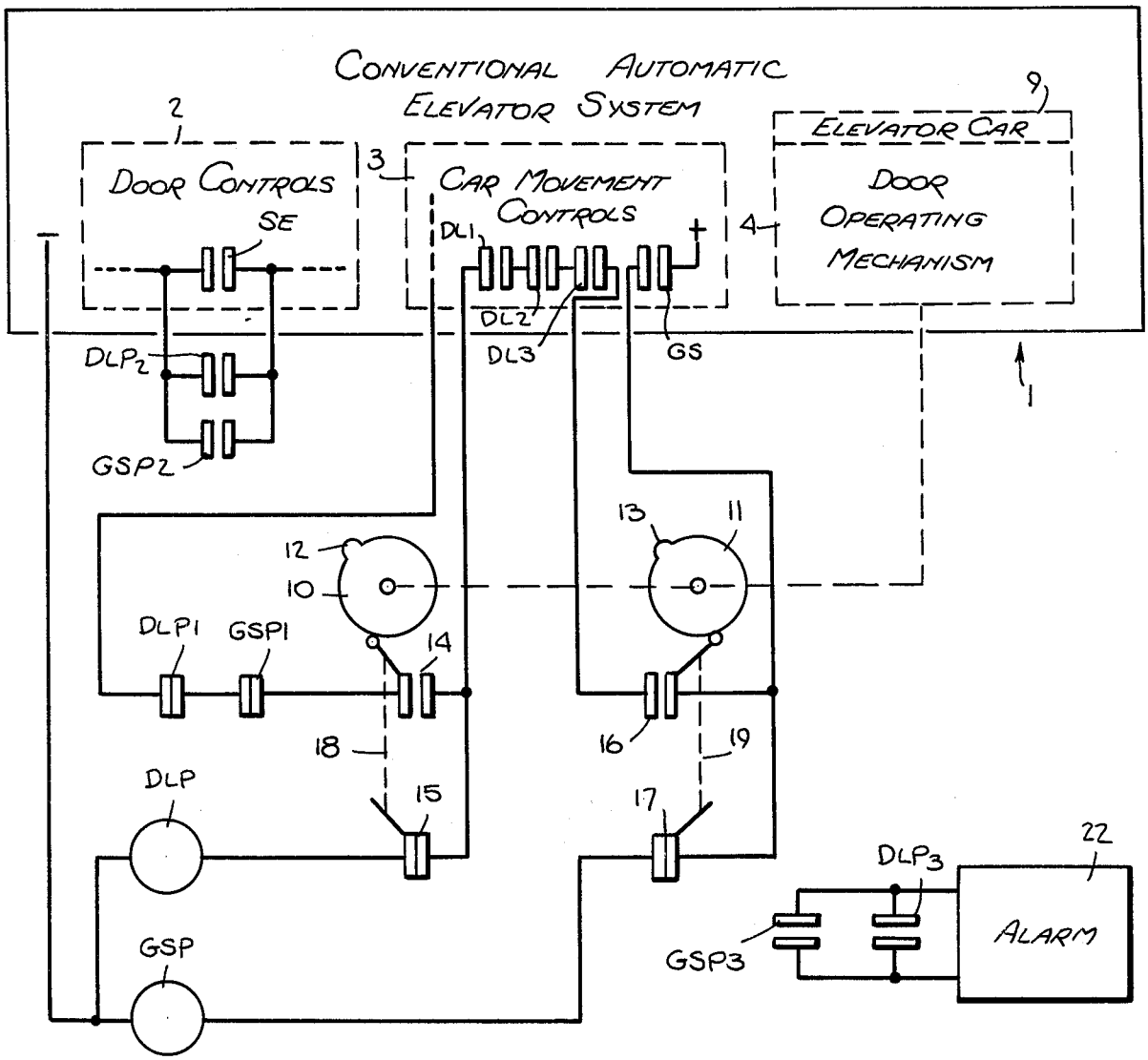
FIG. 1 is a schematic diagram of the preferred embodiment of the invention for use in connection with elevator systems having both an automatically driven car door and an automatically driven hoistway or floor door.
Figure 2:
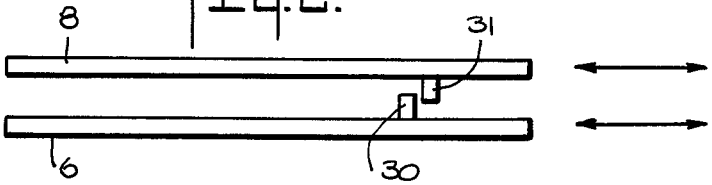
FIG. 2 is a diagrammatic, fragmentary, top view of a one-part, sliding hoistway door and a one-part, sliding car door.

FIG. 1 illustrates schematically such a conventional automatic elevator system with the rectangle 1, and the dashed line rectangles 2, 3 and 4 represent, respectively, the door controls, car movement controls and door operating mechanism usually associated with such an elevator system. For the purposes of illustrating the first embodiment of the invention, it will be assumed that the system 1 has a sliding car door 6 and a sliding hoistway or floor door 8 as illustrated in FIG. 2. However, it will be understood that the system may have a sliding car door 5 (FIG. 3) having two parts **6*a* and 6*b* and each hoistway or floor door 7 may have two parts 8*a* and 8*b* as illustrated in FIG. 2. It will also be assumed that there is a motor driven door operating mechanism at the top of the elevator car 9 which opens and closes both the car and the hoistway doors 6 and 8 under control of the door controls 2, and the door controls 2 include a safety edge switch with contacts SE which, when at least momentarily closed, normally cause the car and hoistway doors 6 and 8** to reopen and after reaching full open positions, again move toward their closed positions.

In the elevator system assumed for purposes of illustration, it will also be assumed that the elevator car travels between three floors, although there may be a greater or lesser number of floors and that there also are switches at each floor providing at least a pair of contacts DL1, DL2 and DL3 which are closed when the locking mechanism for the doors, operable in conjunction with the door operating mechanism 4, locks the doors so as to prevent manual openings thereof. Thus, there are contacts DL1 at one floor, contacts DL2 at the second floor and contacts DL3 at the third floor which are open at a floor where the car is located when the doors are not closed and locked, but such contacts are closed when the doors are closed and locked. In addition, there is a switch having a pair of contacts GS which are closed when the car door 6, also known as a "gate", approaches its fully closed position. The contacts DL1, DL2 and DL3 and GS are normally connected in series so that when they are all closed, circuits on the car controls 3 are completed and the car 9 moves from a floor.

Such contacts GS normally are opened and closed by the car door but may be opened and closed by any means which corresponds in position with the position of the car door. In accordance with the invention, one or more cams 10 and 11 are added to the door operating mechanism 4 so that the projections 12 and 13 thereof correspond in position to the position of the car door 5 and, respectively, operate the contacts 14 and 15 and the contacts 16 and 17 of a pair of micro-switches 18 and 19. The cam 10 operates the contacts 14 and 15, i.e., closes the contacts 14 and opens the contacts 15 just before the door locking contacts at the floor where the car is located, e.g. contacts DL1, DL2 or DL3, are closed. The cam 11 operates the contacts 16 and 17, i.e., closes the contacts 16 and opens the contacts 17 just before the contacts GS are closed.

The relay DLP is connected in series with the contacts 15, but contacts DL1, DL2 and DL3, the contacts 16 and the contacts GS. Therefore, when all of the contacts are closed, the relay DLP is energized causing closing of its contacts DLP2 and DLP3 and opening of its contacts DLP1.

A relay GSP is connected in series with the contacts 17 and the contacts GS. Accordingly, when the contacts 17 and GS are closed, the relay GSP is energized, which causes the closing of its contacts GSP2 and GSP3 and opening of its contacts GSP1.

The usual operation of the contacts DL1, DL2, DL3 and GS and the settings of the cams 10 and 11 in the preferred embodiments of the invention are such as to provide the following sequence:

| Contacts | Operation |
|---|---|
| DL1, DL2 & DL3 | Open except when hoistway door fully closed and locked, which occurs when car door within ⅜ in. of fully closed |
| GS | Open except when car door within 2 ins. of fully closed |
| 14 | Open except when car door within ¾ in. of fully closed |
| 15 | Reverse of 14 |
| 16 | Open except when car door within 2 ½ ins. of fully closed |
| 17 | Reverse of 16 |

The examples of operations given hereinafter illustrate the operations with respect to one floor, but it is to be understood that the operations are the same at each floor at which the elevator car stops.

NORMAL OPERATION

Let it be assumed that the elevator system is operating normally, i.e., the contacts DL1, DL2 and DL3 and GS have not been interconnected either by manual operation thereof or otherwise, and that the car and the hoistway doors are open, the car 9 being stopped at the floor having contacts DL1. Contacts DL2 and DL3, at the second and third floors, will be closed because the hoistway doors at such latter floors are closed and locked. The car movement controls 3 then complete circuits causing the door operating mechanism to move the doors 6 and 8 toward their closed positions, and as the car door 6 reaches a position within approximately 2½ ins. of its fully closed position, the contacts 16 close interconnecting the GS and DL2 contacts and the contacts 17 open thereby opening the energizing circuit for the relay GSP.

As the car door 6 reaches the position within approximately 2 ins. of its fully closed position, the contacts GS close. As the car door 6 then reaches a position within approximately ¾ in. from its fully closed position, the contacts 14 close and the contacts 15 open, the opening of the contacts 15 interrupting the energizing circuit for the relay DLP. Thereafter, when the hoistway 8 becomes fully closed and the car door 6 is within ⅜ in. of its fully closed position, the contacts DL1 close completing the circuit for the starting of the car 9 by way of contacts GS, 16, DL1, DL2, DL3, 14, GSP1 and DLP1.

CAR DOOR CONTACTS INTERCONNECTED

Let it next be assumed that the car 9 is stopped at the first floor with the car and hoistway doors open. Let it also be assumed that the car door contacts GS have either been manually operated or by-passed, e.g., by a shunt or short, and the car hoistway doors commence to close. When the car door 6 and the hoistway door 8 have reached positions approximately 2½ ins. from their fully closed positions, it is physically impossible to gain access to the gate or car door switch which includes the contacts GS. However, if the contacts GS are closed or by-passed prior to the time that the doors 6 and 8 have reached such position, and hence, prior to the time that the contacts 16 close and the contacts 17 open, the relay GSP will be energized through the contacts GS, or the by-pass thereof, and the contacts 17. Energizing of the relay GSP will open its contacts GSP1, thereby interrupting the car starting circuits of the controls 3, and will close its contacts GSP2 which are in parallel with the safety edge contacts SE, the closing of the contacts GSP2 causing the doors to re-open and remain open until the contacts GS are opened or the by-pass thereof is removed. In the preferred embodiment of the invention, the relay GSP has contacts GSP3 which are connected to a well-known type of alarm system 22, e.g., a bell or buzzer with an energizing source, and when the contacts GSP3 are closed, by reason of the energization of the relay GSP, the alarm will sound.

The contacts GSP1 are desirable to make certain that the car starting circuits are open when there is tampering with the switch which controls the contacts GS, but it will be noted that if the contacts DL1 have not been tampered with, the car 9 will not start because movement of the car door 6 toward closing will have been reversed before the contacts DL1 close normally. Also, such movement of the car door 6 will have been reversed prior to the closing of the contacts 16 which are in the car starting circuits. For these reasons, the contacts GSP1 may be omitted if the added safety thereof is not desired.

Door Locking Contacts Interconnected

Again let it be assumed that the car 9 is stopped at the first floor with the car and hoistway doors open. When the car door 6 is in the process of closing and reaches a point approximately ¾ in. from its fully closed position, it is impossible to physically gain access to the door interlock which controls the contacts DL1. If, however, the contacts DL1 are closed or by-passed before the car door reaches a position ¾ in. from its fully closed position, the contacts GS, which close when the car door is within 2 ins. of its fully closed position, will complete a circuit through contacts GS, 16, DL1, DL2, DL3 and 15 for energization of the relay DLP, it being noted that the contacts 15 do not open until after the contacts GS close. When the relay DLP is energized the contacts DLP1 open, thereby interrupting the car starting circuits of the controls 3, and the contacts DLP2 close, the contacts DLP2 being in parallel with the safety edge switch contacts SE and causing the doors to reverse and move to their open positions. Preferably, the relay DLP has a pair of contacts DLP3 connected to the alarm system 22 and causing the alarm system to operate when the contacts DLP3 are closed.

As the door 6 re-opens, after closing of the contacts DLP2, it will continue to move to its fully open position but the contacts GS are opened as the door moves towards its fully open position. Such opening of the contacts GS de-energizes the relay DLP which will permit the doors 6 and 8 to again move toward their closed positions after they reach their fully open positions, but if the contacts DL1 are still closed or by-passed, the relay DLP will re-energize as before and the doors 6 and 8 will again re-open and then try to close.

However, the elevator car 9 will not leave the floor because when the contacts GS are closed, the contacts DLP1 are open and do not close until the contacts GS open. Furthermore, although the contacts DLP1 make certain that the car 9 does not start, they may be omitted if desired because door movement is reversed before the contacts 14 close and closing of the contacts 14 is required to complete the car starting circuits.

Accordingly, in the preferred embodiment of the invention for an elevator system having a sliding hoistway door and a sliding car door, movement of a car from a floor is prevented if either the door interlock switch contacts at the floor, e.g., DL1, DL2 or DL3 or the car door switch contacts GS are closed or shunted before the doors reach positions which prevent physical access to such switches from the car or the doorways. If the contacts GS are so closed or shunted, the doors open and remain open. If the door interlock switch at the floor are closed or shunted, the doors open to their fully open positions, again commence to close, reverse their direction of movement, etc. In addition, if the door interlock switch or the contacts GS are closed or shunted, an alarm sounds. However, it will be apparent to those skilled in the art that if it is desired to omit protection against closing or shunting of the door interlock switch contacts or the contacts GS or the sounding of an alarm, the circuits, switches and contacts associated with such features may be omitted. Similarly, other types of door operation may be initiated by the controls of the invention, or if desired, the doors may be permitted to close without permitting departure of the car by omitting the DSLP2 and GSP2 contacts.

As a further aid in preventing closing of the car door 6 without simultaneous closing of the hoistway 8, the car door 6 may be provided with a projection 30 and the hoistway door 8 may be provided with a projection 31 engageable with the projection 30, as shown in FIG. 2, so that the car door 6 cannot be closed unless the hoistway door 8 also closes. Thus, assuming that both doors close in the direction to the right as viewed in FIG. 2, car door 6 cannot be closed unless the door 8 also closes, because of the projections 30 and 31. With such projections 30 and 31, the car 9 cannot start from the floor unless the door 8 is closed and the door 8 cannot be held open to permit access to switches and other apparatus on the car 9 when the door 6 closes.

Figure 3:
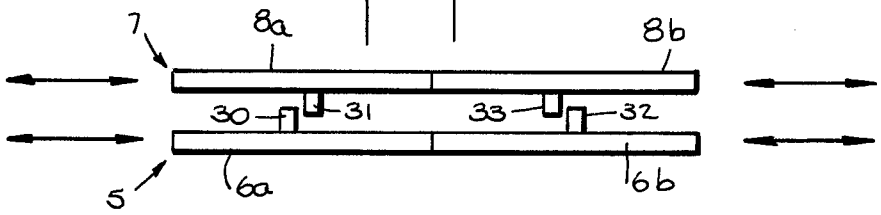
FIG. 3 is a diagrammatic, fragmentary, top view of a two-part sliding hoistway door and a two-part sliding car door.

Similarly, as shown in FIG. 3, the car doors parts 6*a* and 6*b* and the hoistway door parts 8*a* and 8*b* may be provided with interengageable projections 30*a*, 30*b*, 32 and 33 which prevent closing of the door 5 without closing of the door 7. With such interengageable projections 30–33 the car 9 will not start from a floor unless the door 7 is closed.

Conventional Swinging Hoistway Door Systen and Modification

Figure 4:
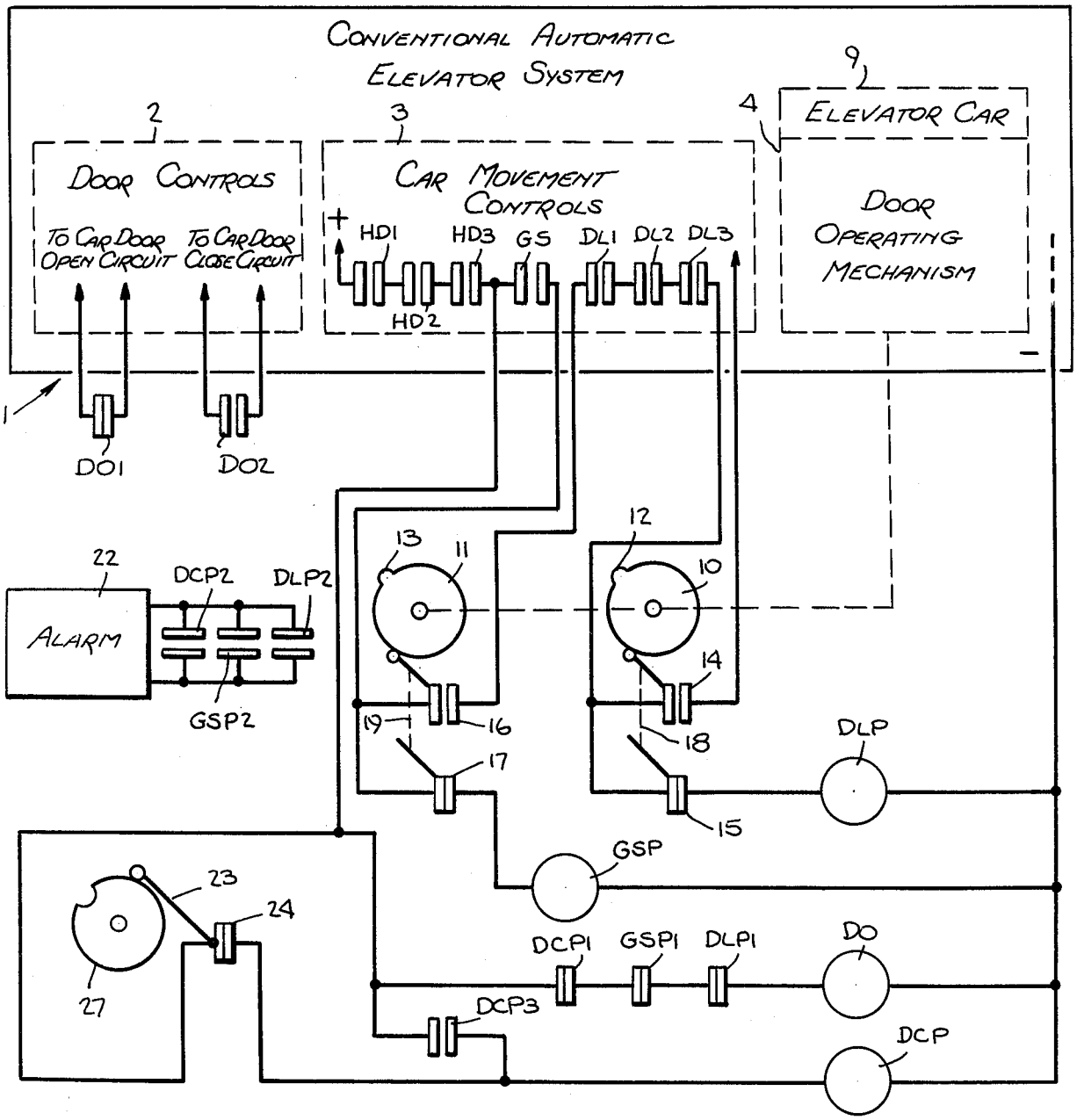
FIG. 4 is a schematic diagram of the preferred embodiment of the invention for use in connection with an elevator system having an automatically driven car door and a manually operable swinging hoistway door.
Figure 5:
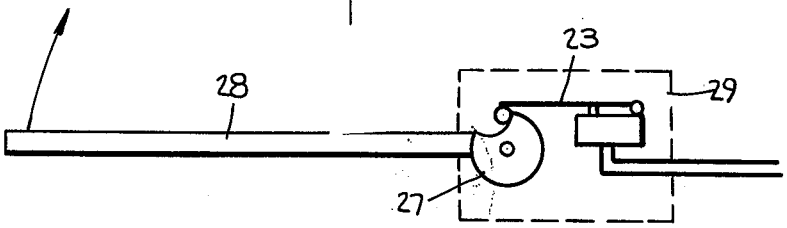
FIG. 5 is a diagrammatic, fragmentary, top view of a swinging hoistway door in conjunction with the switch operated thereby and shown in FIG. 3.

FIG. 4 illustrates a conventional automatic elevator system similar to the system shown in FIG. 1, except for the modifications thereof required to permit employment thereof in an elevator installation in which the hoistway door is a swinging door and is manually operated rather than operated by the car door operating mechanism of the car 9. The car movement controls of the system shown in FIG. 4 differ from the car movement controls in the system shown in FIG. 1 mainly in the addition of the contacts HD1, HD2 and HD3, controlled by the hoistway doors, contacts HD1 being at floor 1, contacts HD2 being at floor 2 and contacts HD3 being at floor 3.

In normal operation of the system shown in FIG. 4 without the modifications of the invention, the contacts HD1–HD3, GS and DL1–DL3 are connected in series so that it is necessary that all of such contacts be closed before the car 9 can move from a floor. Thus, if the hoistway door, the car door and the door interlocks function in their intended manner, the elevator car 9 is permitted to move from a floor.

In the preferred embodiments of the invention, such a conventional elevator system is modified to add the cams 10 and 11 operable by the car door operating mechanism 4 and a pair of micro-switches 18 and 19 operable, respectively, by the cams 10 and 11. The normal interconnection between the contacts DL3 with the conventional car movement controls are interrupted and the contacts DL3 are connected in series with the contacts 14. The contacts 15 and 17, respectively, control energization of the relays DLP and GSP respectively having the contacts DLP1 and DLP2, and the contacts GSP1 and GSP2.

The modification of the conventional elevator system also includes the addition at each floor of a switch 23 having contacts 24, operable by a cam 27 secured to the swinging hoistway door 28 (FIG. 4) so as to rotate as the hoistway door 28 opens and closes. The switch 23 preferably is mounted in the hoistway above the hoistway door, it being understood that there is one such switch 23 for each such hoistway door 28, and preferably, the switch 23 and the cam 27 are enclosed in a tamper-proof housing illustrated by the dotted rectangle 29. The contacts of each switch 23 are connected in parallel with each other, and all contacts are open when all hoistway doors are closed.

Each of the contacts 24 control the energization of a relay DCP having having contacts DCP1, DCP2 and DCP3. The contacts DCP1, GSP1 and DLP1 are connected in series with a relay DO which has contacts DO1 and DO2 connected, respectively, to the car door opening circuit and to the car door closing circuit of the door controls 2.

In the preferred embodiment of the invention, the contacts DCP2, DLP2 and GSP2 are connected to an alarm system 22 so that when any one of such contacts is closed, the alarm system 22 operates.

The usual operation of the contacts DL1–DL3, GS and HD1–HD3 and the settings of the cams 10, 11 and 27 in the preferred embodiment of the invention are such to provide the following sequence:

| Contacts | Operation |
|---|---|
| HD1 - HD3 | Open except when hoistway door substantially closed |
| GS | Open except when car door within 2 in. of fully closed |
| DL1 - DL3 | Open except when car door within ½ in. of fully closed; indicate locking of hoistway door |
| 14 | Open except when car door within 1 in. of fully closed |
| 15 | Reverse of 14 |
| 16 | Open except when car door within 2 ½ ins. of fully closed |
| 17 | Reverse of 16 |
| 24 | Closed except when hoistway door within ¾ in. of fully closed |

NORMAL OPERATION

Let it be assumed that the elevator system is operating normally, i.e., the contacts DL1–DL3, GS and HD1–HD3 have not been interconnected either by manual operation or otherwise, that the car and hoistway doors are open and that the car 9 is stopped at the first floor. As the passenger enters the car and the hoistway door 28 is closed, the contacts 24 open and then the contacts HD1 close. The prior opening of the contacts 24 prevents energization of the relay DCP, but when the contacts HD1 close, the relay DO energizes opening the car door opening circuit at its contacts DO1 and readying the car door closing circuit at its dontacts DO2. Thereafter, by the pressing of a car button or the existence of a floor call, the car movement controls 3 cause the door controls to commence closing of the car door 6. Prior to the closing of the doors contacts GS, the cam 11 operates the switch 19 closing the contacts 16 and opening the contacts 17, the opening of the contacts 17 interrupting the energization circuit for the relay GSP. As the car door 6 continues to close, the cam 10 operates the switch 18 closing the contacts 14 and opening the contacts 15, the opening of the contacts 15 interrupting the energizing circuit for the relay DLP. Thereafter, the contacts DL1 close completing the circuit in the car movement controls 3, which causes the car 9 to start from the floor.

HOISTWAY DOOR CONTACTS INTERCONNECTED

Again let it be assumed that the car 9 is stopped at the first floor with the car and hoistway doors open. When the hoistway door 28 reaches a point approximately ¾ in. from its fully closed position, it is not possible to gain access to the contacts HD1. If, however, the contacts HD1 are interconnected or closed before the hoistway door reaches a position approximately ¾ in. from its fully closed position, the contacts 24 which are closed, complete an obvious energizing circuit for the relay DCP which closes its contats DCP2 and DCP3 and opens its contacts DCP1. The contacts DCP2 operate the alarm system 22 and the contacts DCP3 complete a holding circuit for the relay DCP. The contacts DCP1, being open, interrupt the energizing circuit for the relay DO, which keeps the car door opening circuit in the door controls 2 energized by way of the contacts DO1. Therefore, the car 9 is prevented from leaving the floor, and the car 9 can be placed back into operation only by opening the hoistway door 28 and opening and removing the malfunction of the contacts HD1.

Car Door Contacts Interconnected

Let it be assumed that the car 9 is stopped at the first floor with the car and hoistway doors open and that prior to the time that the car door 6 reaches a position, such as within 2 ins. of its fully closed position, the car door contacts GS have been closed or interconnected. When the hoistway door 28 is closed, the contacts 24 prevent energization of the relay DCP permitting energization of the relay DO and readying of the car door closing circuit.

If the car door switch contacts GS have been closed or interconnected before the cam 11 operates the switch 19 and closes the contacts 16 and opens the contacts 17, the relay GSP will be energized causing opening of its contacts GSP1 and closing of tis contacts GSP2. The opening of the contacts GSP1 de-energizes the relay DO completing the car door opening circuit at its contacts DO2. Accordingly, the car door 6 will open and remain open as long as the contacts GS are closed or interconnected. The contacts GSP2 will activate the alarm system 22, and as long as the relay DO remains de-energized and the car door is open, the car 9 will be prevented from starting from the floor.

Hoistway Door Interlock Contacts Interconnected

Let it be assumed that the car 9 is stopped at the first floor with the car and hoistway doors open, and that prior to the time that the car door 6 reaches a position within approximately 2 ins. of its fully closed position, the contacts DL1 have been closed or interconnected. In the initial stages of door closings, the closing of various switches will be as described in connection with the normal operation of the system, but when the door is approximately 2 ins. from its fully closed position, the car door contacts GS will complete, by way of the contacts 16 which have been closed previously by the cam 11, the closed contacts DL1–DL3 and the still closed contacts 15, a circuit for the energization of the relay DLP. Energization of the relay DLP will de-energize the relay DO by way of the contacts DLP1, which will cause the car door 6 to open as described hereinbefore. The contacts DLP2 of the relay DLP will cause the alarm 22 to sound.

As the car door 6 opens, the contacts GS will open which will cause the relay DLP to de-energize and, therefore, if the door locking contacts DL1–DL3 remain closed or interconnected, the car door 6 may again start to close after it reaches its fully open position, depending upon the nature of the door controls in the elevator system. As long as the contacts DL1–DL3 remain closed or interconnected, the car door 6 will continue to open and then move towards its closed position, but the elevator car 9 will not be permitted to move from the floor.

Accordingly, in the preferred embodiment of the invention for an elevator system having a swinging hoistway door and a sliding car door, movement of a car from a floor is prevented if either the hoistway door contacts HD1, the car door contacts GS or the hoistway door interlock contacts DL1 are closed or shunted before the doors reach positions which prevent physical access to such switches from the car or the doorways. If the hoistway door contacts HD1 or the car door contacts GS are so closed or shunted, the car door 6 opens and remains open. If the door interlock contacts DL1 are so closed or shunted, the car door 6 opens to its fully open position, again commences to close, reverses its direction of movement, etc. In each case, the alarm system 22 sounds. However, it will be apparent to those skilled in the art that if it is desired to omit any one of the protective features, such feature may be omitted by omitting the switches and contacts associated with the omitted feature. Similarly, other types of door operation may be initiated by the controls of the invention.

Although preferred embodiments of the present invention have been illustrated and described, it will be apparent to those skilled in the art that various modifications may be made without departing from the principles of the invention.

What is claimed is:

1. In an automatic elevator system having an elevator car with a car door, means mounting said car in a hoistway extending between a plurality of floors in a building, a floor door at each of said floors for providing access to said car, control means including hoisting apparatus for moving said car from one of said floors to another and stopping said car at a floor, door operating means for automatically opening and closing at least said car door when the car is at a floor and switch means operable in accordance with the positions of said car door and each said floor door for controlling said control means and permitting said control means to move said car from said floor to another when said car door and each said floor door is closed, the combination therewith of further switch means operable in accordance with the position of at least one of said car door and said floor door and normally operable prior to the operation of at least part of said first-mentioned switch means, and means connecting said further switch means in circuit with said control means for preventing movement of said car when said part of said first-mentioned switch means is operated prior to operation of said further switch means.

2. A system as set forth in claim 1, wherein said part of said first-mentioned switch means comprises a switch operable when said floor door is at least substantially closed.

3. A system as set forth in claim 1, wherein said part of said first-mentioned switch means comprises a switch operable when said car door is substantially closed.

4. A system as set forth in claim 1, wherein said system comprises locking means for automatically locking at least one of said car door and said floor door during movement of said car and for automatically unlocking at least said one of said car door and said floor door when said car is stopped at a floor, wherein said first-mentioned switch means comprises locking switches operable by said locking means and wherein said part of said first-mentioned switch means comprises said locking switches.

5. A system as set forth in claim 1, wherein said floor door and said car door are mounted for sliding movement, said door operating means automatically opens and closes both said car door and the floor door at the floor at which the car is stopped and said first-mentioned switch means comprises first contacts which close when said car door is substantially closed and second contacts which close when both said car door and said last-mentioned floor door are closed, said first contacts being said part of said first-mentioned switch means and said second contacts being another part of said first-mentioned switch means, and wherein said further switch means comprises first switch means operable prior to normal operation of said first contacts as said car door closes, second switch means operable prior to normal operation of said second contacts as said car door closes, relay means controlled by said first switch means and said second switch means and including relay contacts, and means connecting contacts of said relay contacts in circuit with said control means.

6. A system as set forth in claim 5, further comprising alarm means and means connecting contacts of said relay means to said alarm means for operating said alarm means when one of said first and second contacts is operated prior to operation respectively of said first and second switches.

7. A system as set forth in claim 1, wherein said car door is mounted for sliding movement and said first floor door is mounted for swinging movement, said door operating means automatically opens and closes said car door at the floor at which the car is stopped and said first-mentioned switch means comprises first contacts which close when said car door is substantially closed, second contacts which close to indicate locking of said floor door and third contacts which close when said floor door is substantially closed, said first contacts being said part of said first-mentioned switch means, said second contacts being another part of said first-mentioned switch means and said third contacts being a further part of said first-mentioned switch means, and wherein said further switch means comprises first switch means operable prior to normal operation of said first contacts as said car door closes, second switch means operable prior to normal operation of said second contacts, third switch means operable prior to normal operation of said third contacts, relay means controlled by said first switch means, said second switch means and said third switch means and including relay contacts, and means connecting contacts of said relay contacts in circuit with said control means.

8. A system as set forth in claim 7, further comprising alarm means and means connecting contacts of said relay means to said alarm means for operating said alarm means when one of said first, second and third contacts is operated prior to operation respectively of said first, second and third switches.

9. A system as set forth in claim 1, wherein said control means comprises door opening means for causing said door operating means to open at least said car door and said further switch means is connected in circuit with said door opening means for energizing the last-mentioned means.

* * * * *

UNITED STATES PATENT AND TRADEMARK OFFICE

CERTIFICATE OF CORRECTION

PATENT NO. : 4,108,281

DATED : August 22, 1978

INVENTOR(S) : Walter G. Glaser

It is certified that error appears in the above-identified patent and that said Letters Patent are hereby corrected as shown below:

Col. 7, line 33 - "DSPL " should read --DLP--

Col. 7, line 50 - "30b" should read --31a--

Col. 12, line 14 - "said first floor" should read --said floor--

Signed and Sealed this

*Third* Day of *April 1979*

[SEAL]

*Attest:*

RUTH C. MASON
*Attesting Officer*

DONALD W. BANNER
*Commissioner of Patents and Trademarks*